US010684006B1

(12) United States Patent
Dunbar

(10) Patent No.: US 10,684,006 B1
(45) Date of Patent: Jun. 16, 2020

(54) ILLUMINATED DRUM MAJOR'S MACE ASSEMBLY

(71) Applicant: Fredrick Dunbar, Martinez, GA (US)

(72) Inventor: Fredrick Dunbar, Martinez, GA (US)

( * ) Notice: Subject to any disclaimer, the term of this patent is extended or adjusted under 35 U.S.C. 154(b) by 0 days.

(21) Appl. No.: 16/505,956

(22) Filed: Jul. 9, 2019

(51) Int. Cl.

| | |
|---|---|
| ***F21V 33/00*** | (2006.01) |
| ***G10G 7/00*** | (2006.01) |
| ***F21L 4/02*** | (2006.01) |
| ***F21V 23/04*** | (2006.01) |
| ***A45B 3/04*** | (2006.01) |
| ***A45B 3/02*** | (2006.01) |

(52) U.S. Cl.
CPC ..... *F21V 33/00* (2013.01); *A45B 3/02* (2013.01); *A45B 3/04* (2013.01); *F21L 4/02* (2013.01); *F21V 23/0414* (2013.01); *G10G 7/00* (2013.01)

(58) Field of Classification Search
CPC ..... F21L 4/02; A45B 3/02; A45B 3/04; G10G 7/00
USPC ..... 362/102
See application file for complete search history.

(56) References Cited

U.S. PATENT DOCUMENTS

| | | | | |
|---|---|---|---|---|
| 2,242,981 | A | 5/1941 | Pederson | |
| 2,681,979 | A | 6/1954 | Manoloff | |
| 2,889,449 | A | 6/1959 | Faloon | |
| 4,600,974 | A | 7/1986 | Lew | |
| 5,081,568 | A | 1/1992 | Dong | |
| 5,212,333 | A | 5/1993 | Aryee | |
| D464,367 | S | 10/2002 | Conrad | |
| 7,287,874 | B2 * | 10/2007 | Irisawa | F21L 4/02 340/815.45 |
| 7,395,629 | B1 * | 7/2008 | Thomas | A01K 77/00 43/11 |
| 10,159,315 | B1 * | 12/2018 | Digiorgio | A45B 3/04 |
| 10,306,958 | B1 * | 6/2019 | Oligie | A45B 3/04 |
| 2008/0094822 | A1 * | 4/2008 | Hsu | F21V 33/0056 362/102 |
| 2010/0232175 | A1 * | 9/2010 | Ho | B60Q 1/26 362/551 |
| 2015/0029701 | A1 * | 1/2015 | Weidman | F21L 4/02 362/102 |
| 2018/0332934 | A1 * | 11/2018 | Cox | A45B 3/04 |

* cited by examiner

*Primary Examiner* — William N Harris

(57) ABSTRACT

An illuminated drum major's mace assembly for enhancing visibility of a drum major's mace at night includes a drum major's mace that is held by a drum major to conduct a marching band. The drum major's mace has a shaft and a crown, and the shaft is comprised of a translucent material. A plurality of light strips is each o coiled around the drum major's mace and forming a double helix coil on the drum major's mace. A plurality of light emitters is each embedded into the drum major's mace. Each of the light emitters emitting light outwardly from the drum major's mace when the light emitters are turned on. Thus, the light emitters and the light strips enhance visibility of the drum major's mace at night.

6 Claims, 5 Drawing Sheets

ILLUMINATED DRUM MAJOR'S MACE ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to illuminated mace devices and more particularly pertains to a new illuminated mace device for enhancing visibility of a drum major's mace at night.

BRIEF SUMMARY OF THE INVENTION

An embodiment of the disclosure meets the needs presented above by generally comprising a drum major's mace that is held by a drum major to conduct a marching band. The drum major's mace has a shaft and a crown, and the shaft is comprised of a translucent material. A plurality of light strips is each o coiled around the drum major's mace and forming a double helix coil on the drum major's mace. A plurality of light emitters is each embedded into the drum major's mace. Each of the light emitters emitting light outwardly from the drum major's mace when the light emitters are turned on. Thus, the light emitters and the light strips enhance visibility of the drum major's mace at night.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
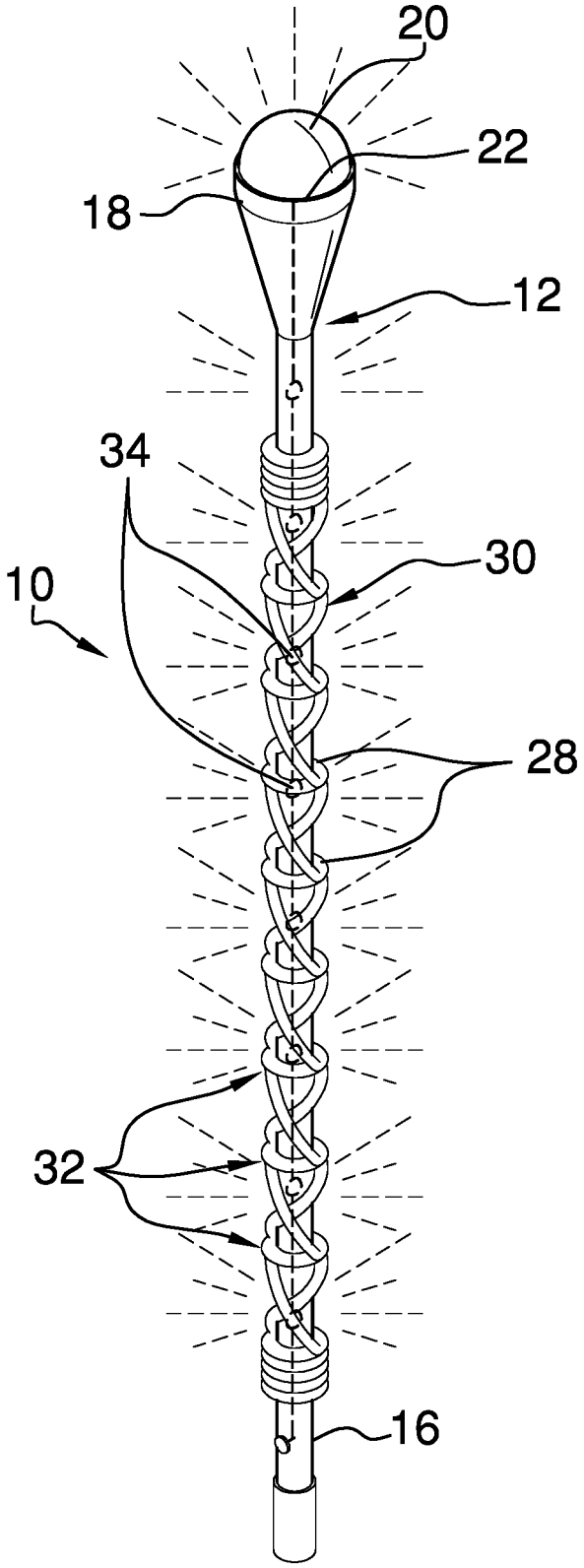
FIG. 1 is a perspective view of an illuminated drum major's mace assembly according to an embodiment of the disclosure.
Figure 2:
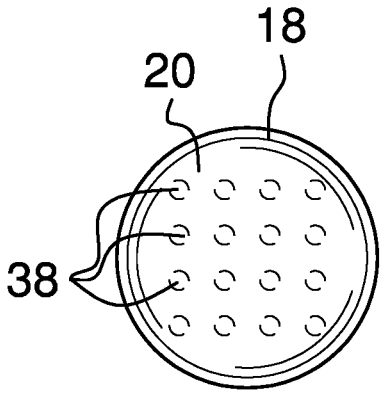
FIG. 2 is a top view of an embodiment of the disclosure.
Figure 3:
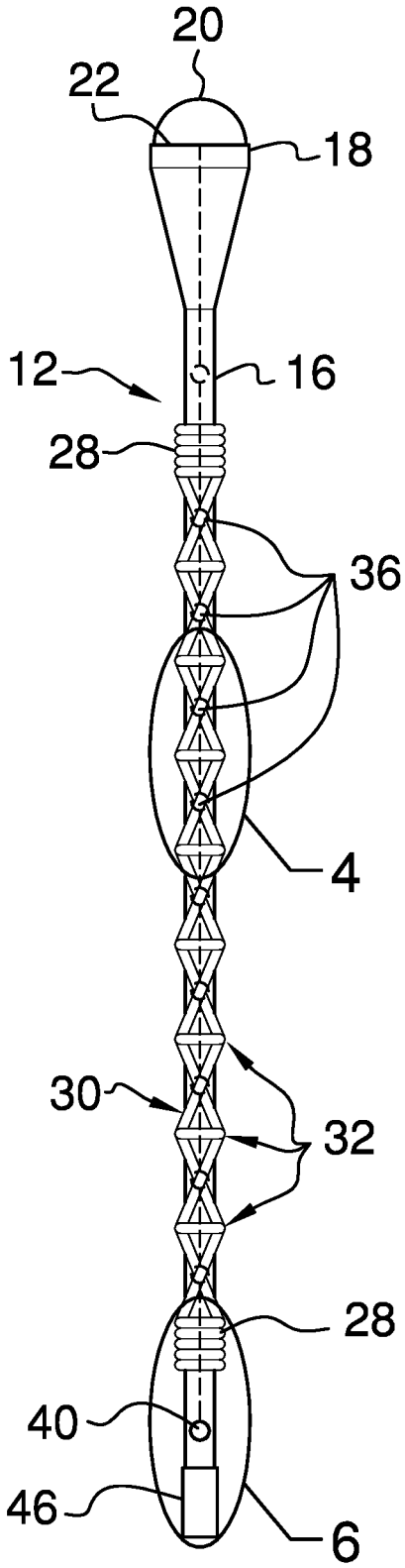
FIG. 3 is a front view of an embodiment of the disclosure.
Figure 4:
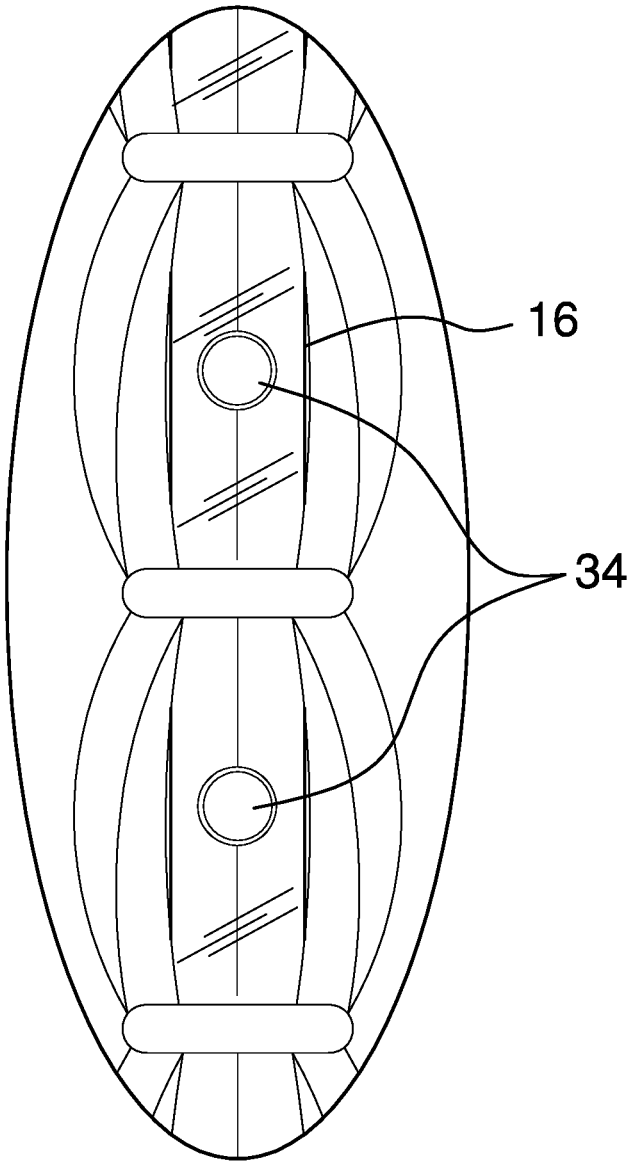
FIG. 4 is a detail view taken from circle 4 of FIG. 3 of an embodiment of the disclosure.
Figure 5:
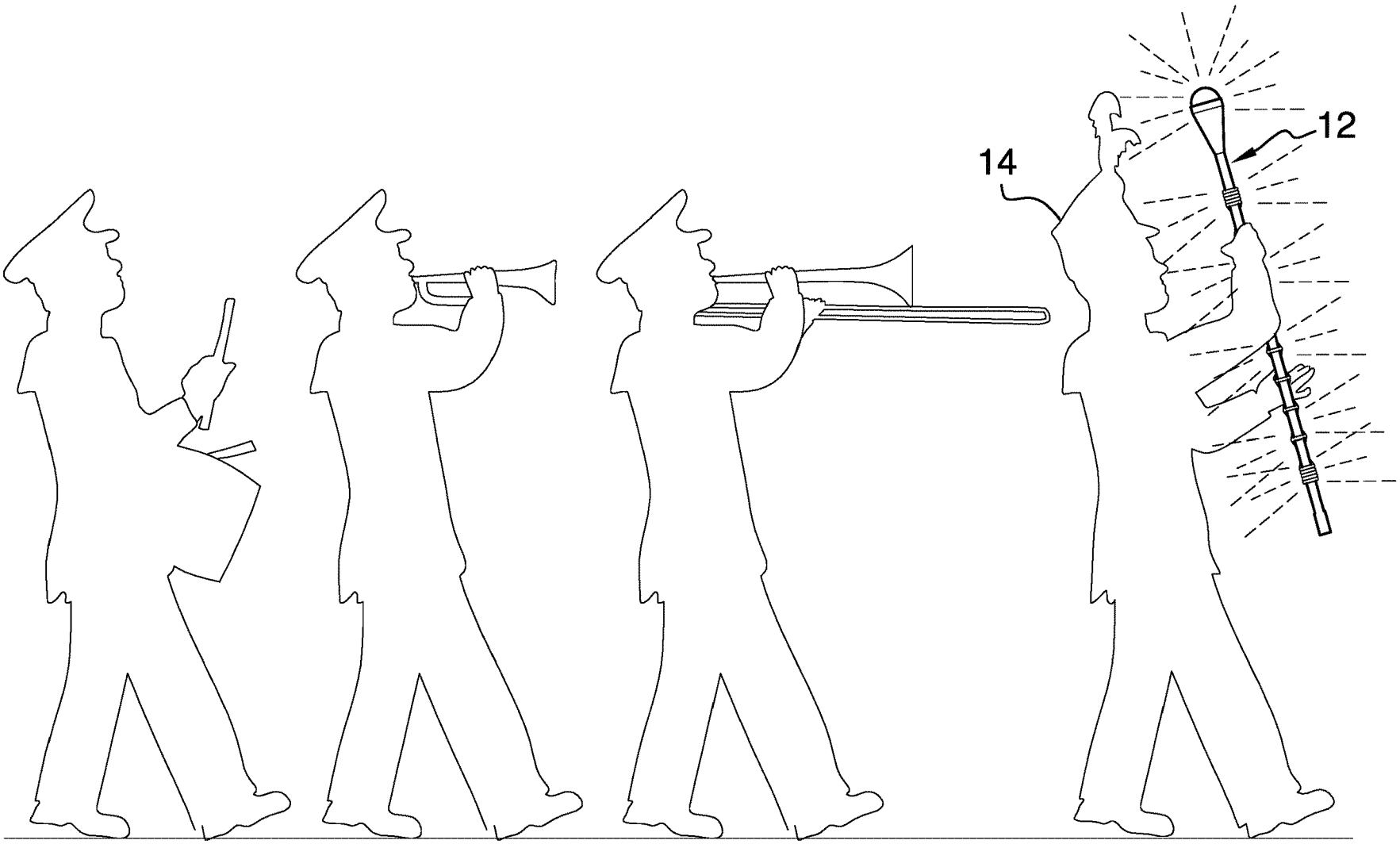
FIG. 5 is a perspective in-use view of an embodiment of the disclosure.
Figure 6:
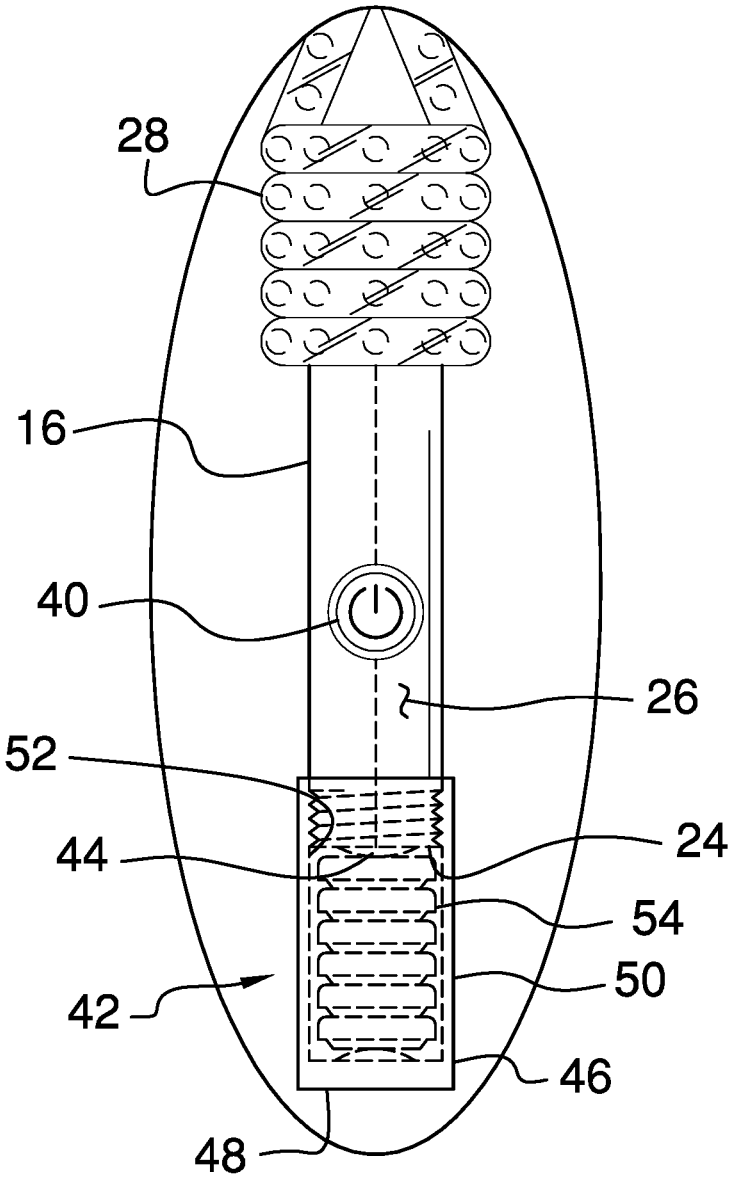
FIG. 6 is a detail view taken from circle 6 of FIG. 3 of an embodiment of the disclosure.

With reference now to the drawings, and in particular to FIGS. 1 through 6 thereof, a new illuminated mace device embodying the principles and concepts of an embodiment of the disclosure and generally designated by the reference numeral 10 will be described.

As best illustrated in FIGS. 1 through 6, the illuminated drum major's mace assembly 10 generally comprises a drum major's mace 12 that is held by a drum major 14 to conduct a marching band. The drum major's mace 12 has a shaft 16 and a crown 18, and the shaft 16 is comprised of a translucent material. The crown 18 includes a lens 20 that is positioned on a distal end 22 of the crown 18. The shaft 16 has a distal end 24 with respect to the crown 18 and an outer surface 26, and the outer surface 26 is threaded adjacent to the distal end 24 of the shaft 16.

A plurality of light strips 28 is included and each of the light strips 28 are coiled around the drum major's mace 12. Moreover, the plurality of light strips 28 forms a double helix coil 30 on the drum major's mace 12 to enhance an ornamental appeal of the drum major's mace 12. Additionally, the light strips 28 are coiled to define a plurality of rings 32 that are interlaced with and are translated along the double helix coil 30. The light strips 28 are positioned on the shaft 16 and the light strips 28 extend along substantially along a length of the shaft 16. Each of the light strips 28 emits visible light outwardly therefrom when the light strips 28 are turned on to enhance visibility of the drum major's mace 12 at night. Each of the light strips 28 may comprise flexible, LED light strips 28 or other type of flexible, electronic light strip.

A plurality of light emitters 34 is each embedded into the drum major's mace 12. Each of the light emitters 34 emits light outwardly from the drum major's mace 12 when the light emitters 34 are turned on to enhance visibility of the drum major's mace 12 at night. Each of the light emitters 34 may comprise an LED or the like. Additionally, the plurality of light emitters 34 may emit a unique color of light with respect to the light strips 28.

The plurality of light emitters 34 includes a set of shaft light emitters 36 and a set of crown light emitters 38. Each of the shaft light emitters 36 is positioned within the shaft 16 thereby facilitating light emitted by the shaft light emitters 36 to pass through the shaft 16. The shaft light emitters 36 are spaced apart from each other and are longitudinally distributed on the shaft 16. Additionally, each of the crown light emitters 38 is embedded in the lens 20 on the crown 18 thereby facilitating light emitted by the crown light emitters 38 to pass through the lens 20.

A switch 40 is movably coupled to the drum major's mace 12. The switch 40 is electrically coupled to each of the light strips 28 and each of the light emitters 34 for turning the light strips 28 and the light emitters 34 on and off. Additionally, the switch 40 is positioned on the shaft 16. A power supply 42 is coupled to the drum major's mace 12 and the power supply 42 is electrically coupled to the switch 40.

The power supply 42 comprises a contact 44 that is coupled to the distal end 24 of the shaft 16 and the contact 44 is electrically coupled to the switch 40. A cup 46 is included that has a basal wall 48 and an outer wall 50 extending away therefrom, and the outer wall 50 has an inside surface 52. The inside surface 52 threadably engages the outer surface 26 of the shaft 16 for removably coupling the cup 46 to the distal end 24 of the shaft 16. The power supply 42 includes at least one battery 54 that is positioned in the cup 46. The at least one battery 54 is in electrical communication with the contact 44 when the cup 46 is removably coupled to the distal end 24 of the shaft 16 thereby placing the at least one battery 54 in electrical communication with the switch 40.

In use, the drum major's mace 12 is held by the drum major 14 for conducting the marching band. The switch 40 is manipulated when the marching band is performing at night or in a darkened environment. Each of the light strips 28 and each of the light emitters 34 are turned on for emitting light when the switch 40 is turned on. Thus, the drum major's mace 12 is clearly visible at night, not only to musicians in the marching band but to spectators as well. In this way the performance of the marching band is enhanced for the marching band and for the spectators when the marching band performs at night.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An illuminated drum major's mace assembly being configured to be held by a drum major for conducting a marching band, said assembly comprising:

a drum major's mace being held by a drum major wherein said drum major's mace is configured to conduct a marching band, said drum major's mace having a shaft and a crown, said shaft being comprised of a translucent material;

a plurality of light strips, each of said light strips being coiled around said drum major's mace having said plurality of light strips forming a double helix coil on said drum major's mace wherein said plurality of light strips is configured to enhance an ornamental appeal of said drum major's mace; and a plurality of light emitters, each of said light emitters being embedded into said drum major's mace, each of said light emitters emitting light outwardly from said drum major's mace when said light emitters are turned on wherein said light emitters are configured to enhance visibility of said drum major's mace at night.

2. The assembly according to claim 1, wherein said light strips are positioned on said shaft, said light strips extending substantially along a length of said shaft, each of said light strips emitting visible light outwardly therefrom when said light strips are turned on wherein said plurality of light strips is configured to enhance visibility of said drum major's mace at night.

3. The assembly according to claim 1, wherein:

said crown includes a lens being positioned on a distal end of said crown, said plurality of light emitters includes a set of shaft light emitters and a set of crown light emitters, each of said shaft light emitters being positioned within said shaft thereby facilitating light emitted by said shaft light emitters to pass through said shaft, said shaft light emitters being spaced apart from each other and being longitudinally distributed on said shaft, each of said crown light emitters being embedded in said lens on said crown thereby facilitating light emitted by said crown light emitters to pass through said lens.

4. The assembly according to claim 1, further comprising a switch being movably coupled to said drum major's mace, said switch being electrically coupled to each of said light strips and each of said light emitters for turning said light strips and said light emitters on and off, said switch being positioned on said shaft.

5. The assembly according to claim 4, further comprising a power supply being coupled to said drum major's mace, said power supply being electrically coupled to said switch, said power supply comprising:

a contact being coupled to a distal end of said shaft, said contact being electrically coupled to said switch;

a cup having a basal wall and an outer wall extending away therefrom, said outer wall having an inside surface, said inside surface threadably engaging an outer surface of said shaft for removably coupling said cup to said distal end of said shaft; and at least one battery being positioned in said cup, said at least one battery being in electrical communication with said contact when said cup is removably coupled to said distal end of said shaft thereby placing said at least one battery in electrical communication with said switch.

6. An illuminated drum major's mace assembly being configured to be held by a drum major for conducting a marching band, said assembly comprising:

a drum major's mace being held by a drum major wherein said drum major's mace is configured to conduct a marching band, said drum major's mace having a shaft and a crown, said shaft being comprised of a translucent material, said crown including a lens being positioned on a distal end of said crown, said shaft having a distal end with respect to said crown and an outer surface, said outer surface being threaded adjacent to said distal end of said shaft;

a plurality of light strips, each of said light strips being coiled around said drum major's mace having said plurality of light strips forming a double helix coil on said drum major's mace wherein said plurality of light strips is configured to enhance an ornamental appeal of said drum major's mace, said light strips being positioned on said shaft, said light strips extending substantially along a length of said shaft, each of said light strips emitting visible light outwardly therefrom when said light strips are turned on wherein said plurality of light strips is configured to enhance visibility of said drum major's mace at night;

a plurality of light emitters, each of said light emitters being embedded into said drum major's mace, each of said light emitters emitting light outwardly from said drum major's mace when said light emitters are turned on wherein said light emitters are configured to enhance visibility of said drum major's mace at night, said plurality of light emitters including a set of shaft light emitters and a set of crown light emitters, each of said shaft light emitters being positioned within said shaft thereby facilitating light emitted by said shaft light emitters to pass through said shaft, said shaft light emitters being spaced apart from each other and being longitudinally distributed on said shaft, each of said crown light emitters being embedded in said lens on said crown thereby facilitating light emitted by said crown light emitters to pass through said lens;

a switch being movably coupled to said drum major's mace, said switch being electrically coupled to each of said light strips and each of said light emitters for turning said light strips and said light emitters on and off, said switch being positioned on said shaft; and a power supply being coupled to said drum major's mace, said power supply being electrically coupled to said switch, said power supply comprising:

a contact being coupled to said distal end of said shaft, said contact being electrically coupled to said switch;

a cup having a basal wall and an outer wall extending away therefrom, said outer wall having an inside surface, said inside surface threadably engaging said outer surface of said shaft for removably coupling said cup to said distal end of said shaft; and at least one battery being positioned in said cup, said at least one battery being in electrical communication with said contact when said cup is removably coupled to said distal end of said shaft thereby placing said at least one battery in electrical communication with said switch.

* * * * *